United States Patent [19]

Henderson et al.

[11] 4,166,442

[45] Sep. 4, 1979

[54] PROTECTION OF INTERNAL COMBUSTION ENGINES AND/OR VEHICLES EMBODYING THE SAME

[75] Inventors: Henning M. Henderson, Willowdale, Canada; Burton Weakley, Verwoerdburg, South Africa

[73] Assignee: Computer Driver Control Holdings (Proprietary) Limited, South Africa

[21] Appl. No.: 793,874

[22] Filed: May 4, 1977

[30] Foreign Application Priority Data

| | | | |
|---|---|---|---|
| May 6, 1976 | [ZA] | South Africa | 76/2711 |
| May 6, 1976 | [ZA] | South Africa | 76/2713 |
| Sep. 28, 1976 | [ZA] | South Africa | 76/5827 |
| Feb. 16, 1977 | [ZA] | South Africa | 77/0921 |

[51] Int. Cl.[2] ..... F02B 77/08

[52] U.S. Cl. ..... 123/198 D; 192/0.084; 192/30 W; 180/271

[58] Field of Search ..... 192/0.084, 30 W; 123/198 D, 198 DB; 180/82 R, 92, 95, 103 BP

[56] References Cited

U.S. PATENT DOCUMENTS

| | | | |
|---|---|---|---|
| 2,059,641 | 11/1936 | Hustad | 192/0.084 |
| 2,425,985 | 8/1947 | Blomberg | 192/30 W |
| 2,494,269 | 1/1950 | Sparkes | 192/30 W |
| 3,645,245 | 2/1972 | Hammond et al. | 123/198 DB |
| 3,750,640 | 8/1973 | Kühn | 123/198 D |
| 3,763,397 | 10/1973 | Yockers | 123/198 D |
| 3,777,729 | 12/1973 | Coté | 123/198 DB X |
| 3,916,865 | 11/1975 | Kiencke et al. | 123/198 DB |
| 3,917,041 | 11/1975 | Walberg | 192/30 W |
| 4,019,489 | 4/1977 | Cartmill | 123/198 D |

*Primary Examiner*—Ira S. Lazarus

*Attorney, Agent, or Firm*—Stevens, Davis, Miller & Mosher

[57] ABSTRACT

A protective device for internal combustion engines and/or vehicles embodying same including means for detecting one or more abnormal conditions of a part of such engine or vehicle such as the temperature of a part, clutch slip, or excessive engine speed, and means activated by the detecting means for at least partially dethrottling the engine and optionally also declutching same and/or applying the brakes in the case of a vehicle.

16 Claims, 11 Drawing Figures

Fig 6.
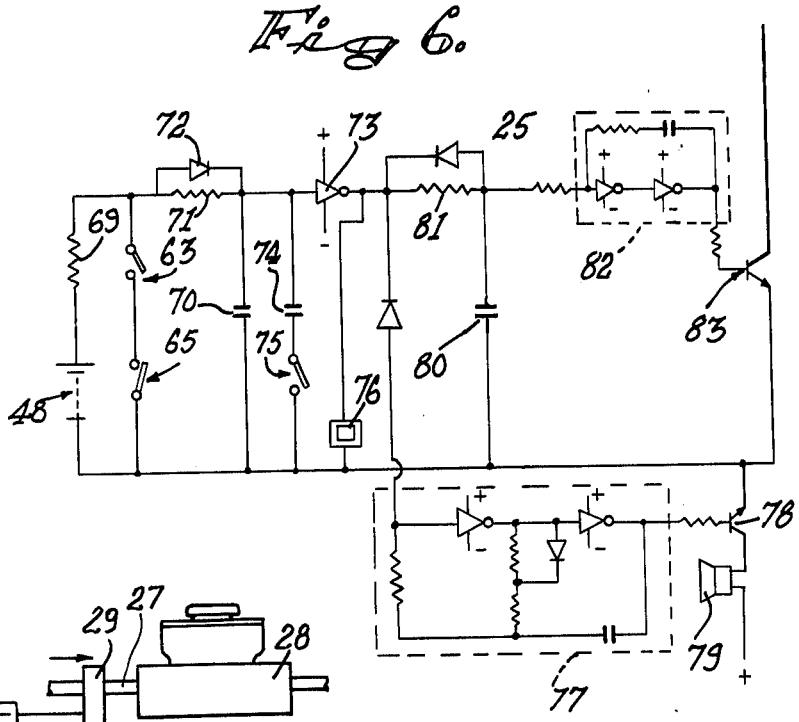
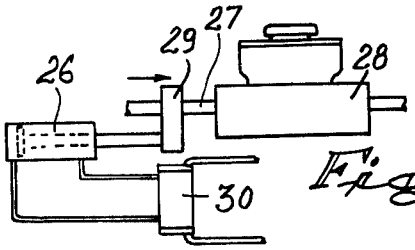
Fig 8.
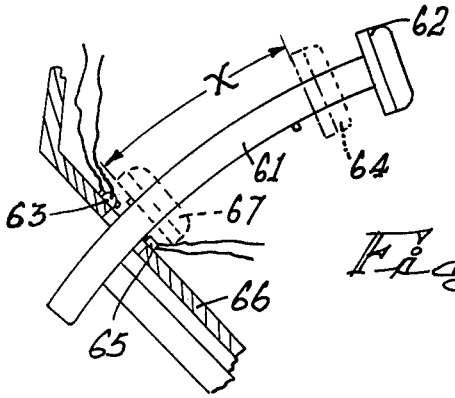
Fig 5.

PROTECTION OF INTERNAL COMBUSTION ENGINES AND/OR VEHICLES EMBODYING THE SAME

This invention relates to the protection of internal combustion engines and/or vehicles having such an engine as its motive power and more particularly the invention is concerned with such protection in the event of abnormal conditions developing in such engine or vehicle, or in some cases, abuse thereof.

Internal combustion engines are susceptible to damage as a result of a variety of abnormal conditions developing in such an engine. These conditions include overheating regardless of the cause thereof, loss of oil pressure, causing the engine to operate at excessive speeds or running the engine under load or at normally acceptable speeds when the engine is cold. Also, a vehicle can be placed in danger as a result of overheating of the brakes thereof since overheating tends to lower the efficiency of the brakes.

Additionally, malfunctioning of other parts of a vehicle can give rise to greater damage being done when such malfunctioning is not detected at an early stage. Malfunctioning will generally give rise to the part heating up. Such a part could be a differential, a gear box, a torque converter, a clutch housing or an automatic transmission housing.

Also abuse of a friction clutch associated with a vehicle can give rise to costly maintenance.

Such misuse of clutches generally takes two forms; the one is that the clutch is released too suddenly and the other is that the clutch is allowed to slip for too long a period of time. The first type of misuse may be recorded by any device sensitive to accelleration and is not considered hereinafter. The occurrence of a clutch being allowed to slip for too long a period of time will be considered as an abnormal condition for the purposes of description.

It is the object of this invention to provide a protective device which will, at least in many instances, prevent, avoid, or minimize such damage occurring should such abnormal conditions prevail.

In accordance with this invention a protective device for internal combustion engines and/or vehicles embodying same, is provided including first means for detecting an abnormal condition of a part of said engine or vehicle and further means, actuated by said first means, for at least partially de-throttling the engine upon the detection of such abnormal condition.

Further features of the invention provide for the said first means to comprise one or more of an oil pressure operated switch, a temperature operated switch, a revolution counter and/or a timer associated with a clutch for timing the period during which slippage can occur; for the said further means to operate to uncouple an accelerator linkage or coupling or preferably to positively move such linkage or coupling to de-throttle the engine; for third means to be provided for de-clutching the engine under certain of such abnormal conditions occurring, and for the further and third means to be operated by an hydraulic circuit supplied by an hydraulic storage vessel wherein actuation is effected by one or more solenoid controlled valve arrangements.

Still further features of the invention provide for a brake to be automatically brought into operation under predetermined abnormal conditions, for the means for bringing such brake into operation to be hydraulically operated and for such means to be actuated by a solenoid controlled valve arrangement. Preferably, where the latter feature is utilized means are embodied for illuminating the brake lights, where this would otherwise not occur, and/or emergency flasher lights of a vehicle.

In regard to the clutch protection the sensing means may simply take the form of a switch arranged to be closed once the clutch pedal has been depressed to the extent at which disengagement should commence. The timing means in this case may be simply arranged to activate a warning means and simultaneously, or subsequently the dethrottling means and preferably disabling means after a length of time calculated to allow any normal clutch operation to take place.

It is preferred to have two switches in series whereof one is a normally open switch adapted to be closed once the clutch pedal has been depressed to an extent at which disengagement should commence. The second switch is a normally closed switch and is adapted to open when the clutch pedal has been fully depressed in which condition the clutch is fully disengaged. The timing means is preferably a simple electronic circuit wherein timing is effected by capacitors in known manner and which is energised when both switches are closed.

The invention also provides a kit of parts in combination with instructions directing that the parts be associated with an engine and/or vehicle to result in a protective device as above defined.

The above and other features of the invention will become more apparent from the following expanded description of the invention. In this description reference will be made to the accompanying drawings in which:

FIG. 5 illustrates a clutch pedal arrangement;

FIG. 6 is a circuit diagram of a clutch protection circuit;

FIG. 7 is an hydraulic circuit diagram of the protection device;

FIG. 8 illustrates a master cylinder brake unit adapted according to the invention;

In this description a large number of abnormal conditions will be described as giving rise to dethrottling of a vehicle engine and also optionally declutching and in some cases giving rise to the brakes of the vehicle being applied. However, it is to be understood that the scope of the invention applies to only one such abnormal condition being used to cause dethrottling of an engine and the scope of the invention is further not confined to vehicle or like engines but could be applied to stationary engines.

Figure 1:
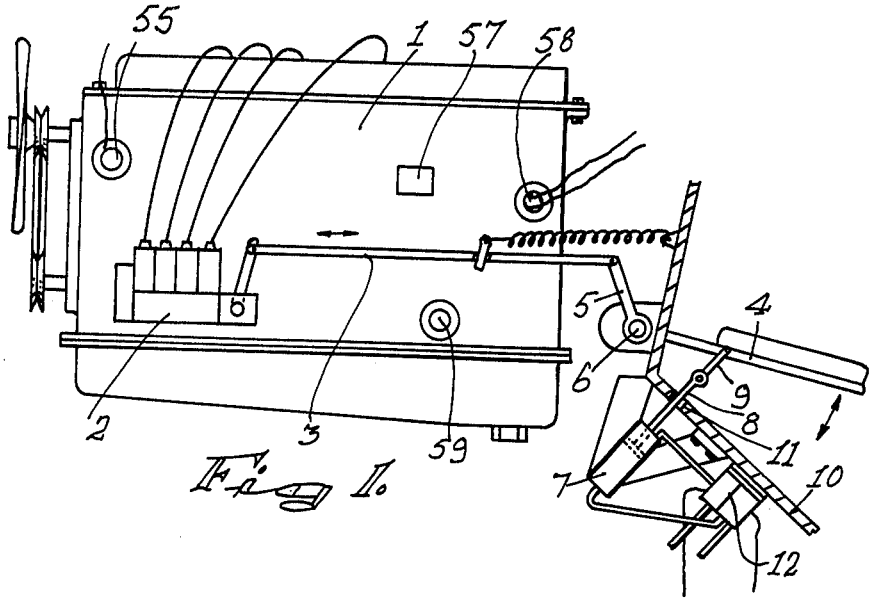
FIG. 1 is a diagrammatic side view of a vehicle engine illustrating the throttle mechanism thereof.

Referring now to FIG. 1 a diesel engine 1 of a vehicle is provided with the usual injector pump 2 which is operated through a spring biased operating rod 3 by a foot pedal 4 and associated rotatably mounted lever arm 5 which pivots about an axle 6 in unison with the pedal.

In this embodiment of the invention a double acting piston and cylinder assembly 7 is mounted so that the piston rod 8 extends substantially transverse to the pedal 4 and is coupled thereto by a pivotally connected link 9. Conveniently the piston and cylinder assembly is mounted beneath the floor board 10 of the vehicle with the piston rod extending through an aperture 11 in the floor board.

Figure 3:
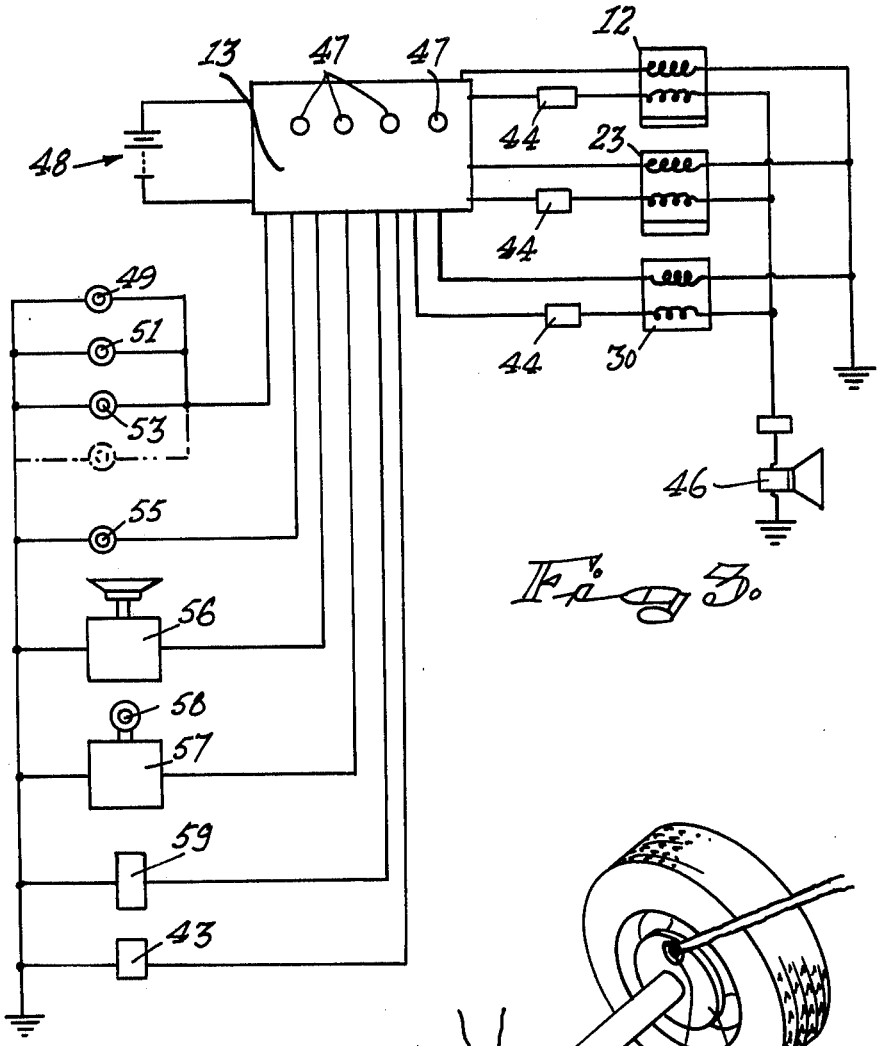
FIG. 3 illustrates in block form a control unit and associated parts.
Figure 4:
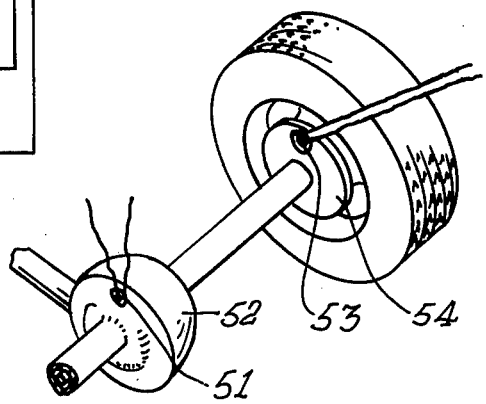
FIG. 4 illustrates schematically a differential and one associated rear wheel.
Figure 4:
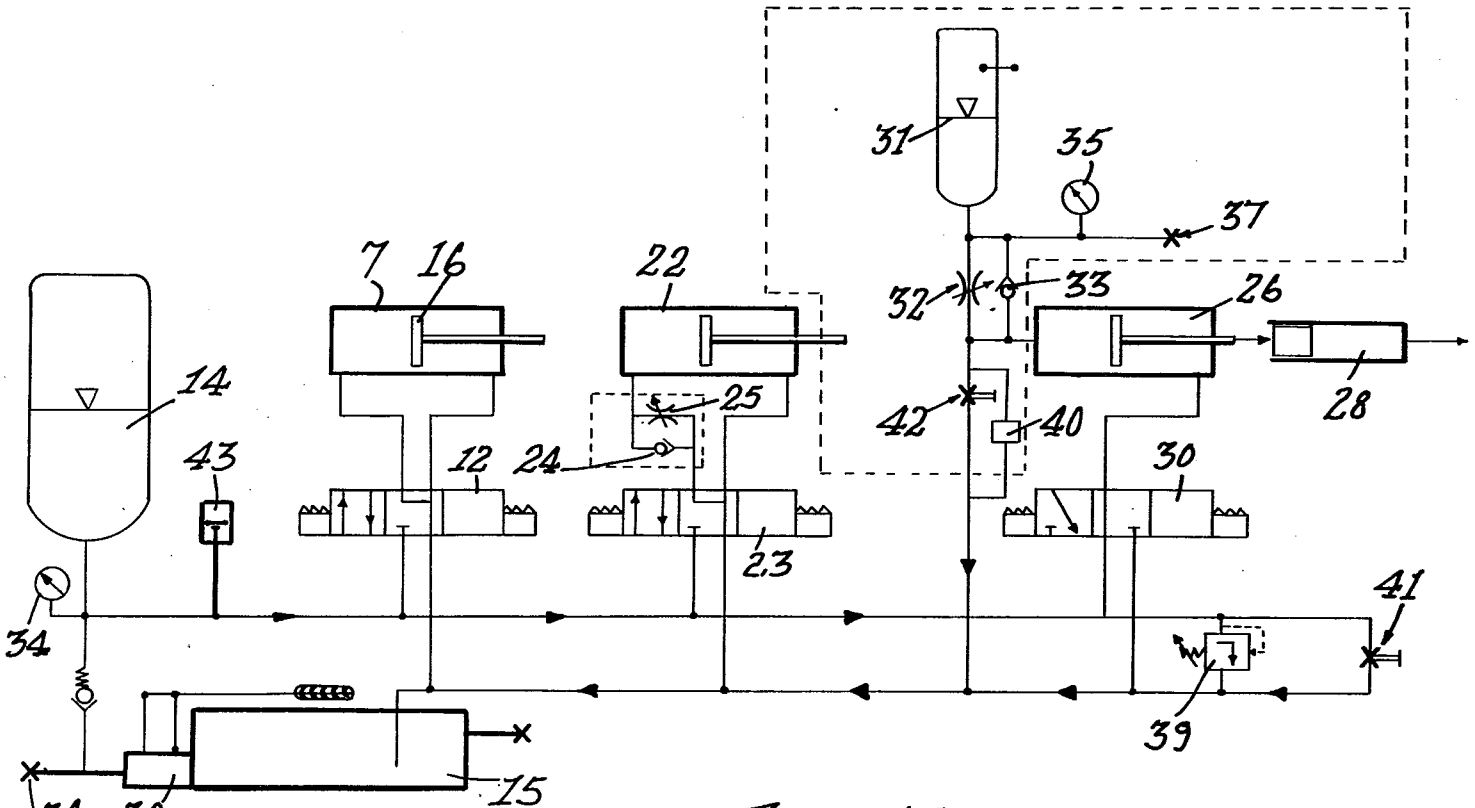

The piston and cylinder assembly 7 is connected to a double acting solenoid controlled valve 12 which is supplied with electrical current from a control unit 13 which is depicted in FIG. 3.

Referring now to FIG. 7 the piston and cylinder assembly 7 is connected to a high pressure supply reservoir 14 and to a reserve tank 15 which is at atmospheric pressure by way of the double acting solenoid controlled valve 12.

The solenoid controlled valve 12 is, when no abnormal condition exists, maintained positively in a position in which both sides of the piston 16 are connected to the reserve tank at a position beneath the fluid level therein. However, when an abnormal condition exists the control unit 13 switches over to energise the other solenoid and move the valve to a position in which the high pressure hydraulic fluid supply is connected to one side of the piston to simply force the accelerator pedal 4 to an upper position corresponding to the idling condition of the engine or any other preselected throttle position which decreases the engine speed. The pressure of the fluid in the high pressure supply can be made sufficiently high to prevent any person from being able to depress the accelerator pedal in this condition of the piston and cylinder assembly. A suitable pressure is considered to be between 10 and 30 Megapascals.

It will be understood that as soon as the abnormal condition returns to normal the control unit will again switch over to cause both sides of the piston to be connected to the reserve tank 15 in which case free movement of the piston in the cylinder is allowed with fluid simply passing from one end of the cylinder to the other.

Figure 2:
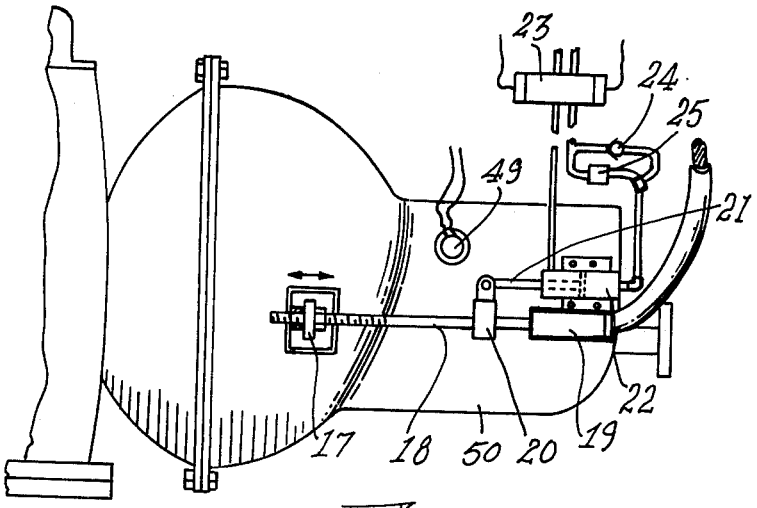
FIG. 2 is a similar elevation of a clutch housing and gear box of the vehicle.

Under certain abnormal conditions in particular where excessive clutch slippage is allowed, it is also desirable to declutch the vehicle and the declutching arrangement is illustrated in FIG. 2. In this case the clutch operating lever 17 is actuated by an axially movable rod 18 which in turn is operated by a slave cylinder 19 in the usual way. Secured to the axially movable rod is an anchorage 20 to which is attached the piston rod 21 of a second double acting piston and cylinder assembly 22 which again is controlled through a double acting solenoid controlled valve 23. In one position of the solenoid controlled valve free flow of hydraulic fluid is allowed between the ends of the cylinder with the restriction described below. In the other position of the solenoid controlled valve, the high pressure hydraulic fluid supply is connected to one side of the cylinder such that the axially movable rod is moved to declutch the vehicle. The double acting piston and cylinder assembly is controlled somewhat by a one way valve 24 and restricted by-pass 25 connected into the hydraulic line to the solenoid controlled valve in a manner such that the one way valve is closed to flow of fluid when movement of the piston is in a direction corresponding to engagement of the clutch but the one way valve opens when the piston moves in the direction to disengage the clutch. The effect of this is to limit the rate at which a clutch can be engaged simply to prevent damage occurring to the vehicle by somebody engaging a clutch suddenly.

In certain further instances such as where brakes overheat the brakes of the vehicle are also preferably applied automatically and to this end a third double acting piston and cylinder assembly 26 is associated with the operating rod 27 passing into the usual master cylinder 28 or the like. This association is effected such that the double acting piston and cylinder assembly 26 can act on a stop 29 on the normal operating rod 27 to move it in a direction to promote braking. When the double acting piston and cylinder assembly is inoperative it has no effect on, and is not moved by, normal operation of the brakes. A third double acting solenoid controlled valve 30 controls the hydraulic fluid supply from the high pressure supply to the piston and cylinder assembly 26 to maintain the latter in a retracted and inoperative position. A further hydraulic fluid supply under a substantially lower pressure say for example 6 Kilopascals, supplies the other end of the cylinder and this second fluid supply 31 is the one to actually effect braking in the event of this being necessary. In such an event the double solenoid controlled valve assembly moves to close off the high pressure supply maintaining the piston in an inoperative position and to connect that side of the piston to the reserve tank. This enables the second hydraulic fluid supply to apply the brakes of the vehicle. The latter is preferably effected by allowing the hydraulic fluid from the second supply to pass through a restricted orifice 32 which ensures therefore that the brakes are applied gradually. A one way by-pass 33 in parallel with the restricted orifice ensures that the brakes can be released rapidly when the high pressure hydraulic supply is re-connected through the solenoid operated valve 30 to move the piston to an inoperative position.

The hydraulic circuit above described is one in which the hydraulic fluid supply is simply charged to the required pressure and thus after a period of time and a number of operations the device must be recharged. Each of the hydraulic fluid supplies has a pressure gauge 34,35 connected thereto and a recharge point 36,37 whereby they may be recharged with hydraulic fluid under pressure. Each recharge point is connected through a non-return valve to the associated supply reservoir. Alternatively, a hand pump such as that indicated at 38 in the high pressure side may be used to recharge the hydraulic fluid supplies in the case of emergencies. Finally, both fluid supplies are provided with a relief valve 39,40 which will relieve excess pressure back to the reserve tank and also a system over-ride stop cock 41,42 is provided in each system to enable the entire protection device to be rendered inoperative by opening these valves. Such stop cocks are generally sealed since they are only to be opened in an emergency.

A pressure switch 43 connected to the high pressure hydraulic fluid supply is arranged to function as an abnormal condition switch as will be described hereunder.

Referring now to FIG. 3, the control unit 13, as will be clear from the above, is arranged to operate the three double acting solenoid valves selectively according to the abnormal condition sensed, whilst in all cases it activates the solenoid controlled valve 12 which causes dethrottling of the engine. Each operation of each of these solenoid controlled valves can be used to activate a counter 44 associated with each circuit or they could collectively activate a single counter 45. An audible alarm 46 is sounded each time the engine is dethrottled and light bulbs 47 on the control unit or located in any other suitable position, could be used to indicate by becoming illuminated, the cause of the dethrottling. The switching circuit within the control unit is simply a system of relays and will not be described herein as their arrangement will be totally obvious to any skilled electrician or automotive electrician. The inputs to a control unit, which is powered from the vehicle battery 48, are various and are listed hereunder:

a. a thermal switch 49 attached to the gear box 50 (FIGS. 2 and 3);

b. a thermal switch 51 attached to a differential 52;

c. a thermal switch 53, one of which is attached to each brake supporting disc 54 of the vehicle.

In each of these cases the thermal switch simply closes a circuit embodying one or more relays arranged to change the energisation of the coils of the selected double acting solenoid valves.

d. a thermal switch 55 attached to the engine of the vehicle and arranged to close the circuit when the engine temperature exceeds a predetermined maximum.

e. a clutch slip sensing device 56 arranged to close the required circuits in the event of excessive clutch slippage.

f. an engine speed detecting device 57 which is adapted to close when the engine speed exceeds a predetermined maximum at normal running temperatures and when it exceeds a lower maximum when the engine is below a preselected minimum running temperature. To this end a second thermal switch 58 is attached to the engine and arranged to switch the speed detecting device from one position to another by simple electrical means such as switching in a pulse divider when the engine is cold. Such a pulse divider would obviously operate on an electrical pulse generating detecting device which could of the the type operating on a strain gauge, for example, attached to a diesel fuel supply pipe which will pulse at a speed proportional to the engine speed. Such a device is described in our co-pending South African Patent Application No. 76/5828 filed on Sept. 28, 1976 and will not be further described herein.

g. an oil pressure switch 59 adapted to be closed by low oil pressure in the vehicle;

h. the pressure switch 43 adapted to close when the pressure in the high pressure hydraulic fluid supply described above falls below a predetermined minimum operating pressure.

In order that the clutch slip protection device may be more fully understood, a description thereof follows:

Insofar as the vehicle itself is concerned there are provided two switches associated with the arm 61 carrying the clutch pedal 62. The first switch 63 (FIGS. 5 and 6) is a normally open switch adapted to be closed once the clutch pedal has been depressed to an extent whereat disengagement of the clutch should commence. This is usually about 3 or 4 centimeters. The position of the clutch pedal upon closure of the first switch is shown by dotted lines 64 in FIG. 5. The second switch 65 is a normally closed switch which is adapted to open when the clutch pedal is depressed to an extent at which the clutch should be fully disengaged i.e. about 4 or 5 centimeters from the floor board 66 as shown by dotted lines 67 in FIG. 5.

Thus the two switches which are connected in series are only closed simultaneously whilst the clutch pedal is in the zone (marked X in FIG. 5) in which clutch slippage usually occurs during a gear change.

Referring now to the circuit diagram of FIG. 6 only, the two series switches are connected across the battery 48 with a protective resistor 69 interposed to prevent a short circuit when both switches are closed. These switches are arranged to discharge a first capacitor 70 through a high resistance 71, the capacitor being rapidly charged upon initial energisation of the circuit through a diode 72 connected across the high resistance 71 when one of the switches is open. The positive of the first capacitor is also connected to the input of an invertor 73; the input of the invertor is thus high when either of the switches is open and thus the output is low.

The first capacitor 70 and its associated discharge resistance 71 are chosen such that, when both switches are closed it takes about three seconds (any other desired time period may be chosen) for the capacitor to discharge sufficiently to cause the input to the invertor 73 to go low. A parallel capacitor 74 is also installed and arranged to increase this time lag by about seven seconds when a reversing switch 75 is closed when the vehicle is in reverse gear. Thus more time is afforded a driver of a vehicle when reversing.

When the output from the invertor goes high (i.e. after the three second time delay or 10 seconds for reversing) it activates a counter 76 which records a "fault" and simultaneously gives rise to two other effects. The first effect is that a two-invertor pulse generating circuit 77 is allowed to function which triggers a transistor 78 with its emitted pulses. The transistor allows a buzzer 79 to operate according to the pulses.

The second effect is that a second timing capacitor 80 begins to charge through a suitable resistor 81 the values of these two components being such that after about eight seconds an associated input to a two invertor holding circuit 82 goes high which triggers a transistor 83. The latter causes current to flow through the associated relays in the control unit to cause the clutch to disengage and the vehicle engine to be dethrottled.

It will be understood that pneumatic pressure may be used in place of the hydraulic system above described and also vacuum operated piston and cylinder assembly may be used in an analagous manner.

As an alternative to the direct operation of a piston and cylinder assembly on the accelerator pedal as described above an accelerator linkage could be rendered ineffective in any suitable manner. Two such manners are described below.

Figure 9:
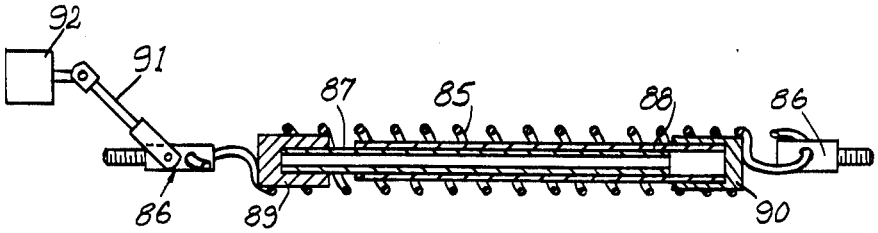
FIGS. 9 & 10 are longitudinal sections of alternative dethrottling means; and, FIG. 11 is a section along line XI—XI in FIG. 10.

In the case illustrated in FIG. 9 an accelerator linkage into which the device is included is adapted to be in tension in use. In this instance a tension spring 85 is provided at each end thereof with a suitable connector piece 86 adapted for inclusion in an accelerator linkage assembly. The spring is adapted to extend when about 8 kg force is exerted thereon. In order to support the spring properly, a pair of telescopically movable tubular members 87 and 88 are located centrally within the spring. Each of these members is provided with a cylindrical fitting 89 and 90 at its one end with the fitting in each case being welded to its associated tubular member. The fittings are each firmly engaged by an end portion of the spring so that as the spring extends, the members move telescopically with respect to each other.

The connector piece 86 more remote from the accelerator pedal assembly has a connecting rod 91 pivotally attached thereto. The connecting rod extends away from the spring at an incline and is pivotally connected at its other end to means for moving it in a direction tending to extend the spring. These means may be a solenoid 92 as in the present example but such means could equally well be a cranked lever operated by an electric motor, a pressure or vacuum operated member such as a piston and cylinder assembly or a diaphragm booster arrangement or even an hydraulic piston and cylinder assembly or hydraulic motor.

In use, the spring is sufficiently resistant to allow for normal operation of the accelerator assembly when conditions of the engine and vehicle are normal. However, should any abnormal condition be present or develop, the solenoid 92 is energised thereby withdrawing the associated connector piece and fitting to cause extension of the spring and a consequent de-throttling of the engine irrespective of the position of the accelerator pedal.

Figure 10:
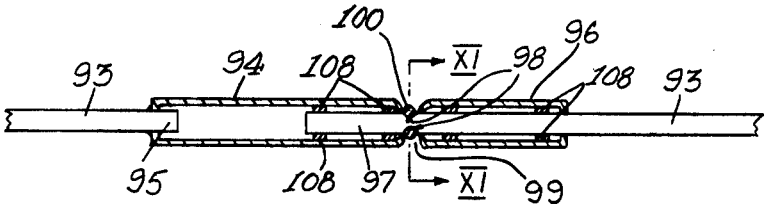
Figure 11:
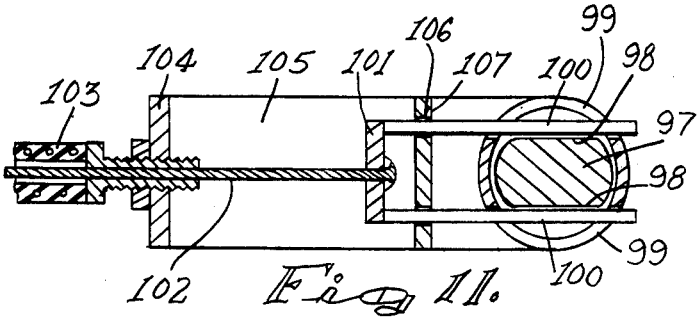

Referring now to FIGS. 10 and 11 a device is provided for removing a connecting element in an accelerator operating rod 93 which moves axially in normal operation. In this case a section of the length of the rod is cut out and a tube 94 is welded to one of the cut ends 95 of such rod.

The opposite end 96 of the tube slidably receives a length of the other cut end 97 of the rod. The latter end 97 of the rod is provided with a pair of diametrically opposed notches 98 and the tube is provided with corresponding cut-out zones 99. The notches and cut-out zones are shaped to receive a retractable pair of coupling members 100 movable transversely with respect to the rod and tube. The coupling members are parallel and interconnected at one end by a transverse plate 101 to which is secured the inner member 102 of a Bowden cable 103. The outer member of the Bowden cable is anchored to a plate 104 carried by a carrier plate 105 welded to the tube. The coupling members in addition pass through perforations 106 in a guide plate 107 secured to the carrier plate.

Thus when the inner member 102 of the Bowden cable is pulled, the coupling members are retracted and the operating rod is rendered ineffective as a result of the cut end 91 being able to slide freely within the tube. It is, however, preferred that the rod and tube be provided with co-operating stops 108 which limit the relative axial movement suitably. When the coupling members are again urged towards the notches the coupling members re-engage the notches and cut-out regions of the tube to couple the rod to the latter. The opposite end of the Bowden cable 13 is connected to a solenoid to be operated thereby or to any other means such as a fluid operated piston and cylinder assembly.

What we claim is:

1. A protective device for a combination including an internal combustion engine and a clutch operatively coupled thereto wherein the clutch is capable of slip during engagement and disengagement thereof, the protective device comprising:

at least one first means for detecting an abnormal operating condition of a part of said combination;

second means, actuated by said first means, for at least partially dethrottling said engine upon detection of said abnormal condition;

third means operatively connected with said first means for disengaging the clutch substantially simultaneously with the activation of said second means for dethrottling the engine.

2. The protective device as claimed in claim 1 wherein said combination is mounted on a motor vehicle which is propelled by said engine through said clutch.

3. A protective device as claimed in claim 2 in which said first means is at least one temperature detecting switch which switches when the temperature of a part of said combination rises to an abnormally high value to actuate said second and third means.

4. A protective device as claimed in claim 3 in which said temperature detecting switch detects an engine temperature.

5. A protective device as claimed in claim 1 in which said first means includes an engine speed detector which switches when a predetermined maximum safe engine speed is exceeded to actuate said second and third means.

6. A protective device as claimed in claim 1 in which said first means includes a clutch slip detecting device which switches when the clutch has slipped for a predetermined period of time to actuate said second and third means.

7. A protective device as claimed in claim 6 in which said clutch slip detecting means comprises a timer which is controlled by a clutch operating member cooperating with switches associated with the fully engaged and fully disengaged position of said clutch, said timer being activated when said operating members is in a position intermediate its fully engaged and fully disengaged positions.

8. A protective device as claimed in claim 2 wherein said motor vehicle includes a braking device, said protective device further comprising fourth means for automatically applying said braking device upon the detection of the occurrence of at least one abnormal condition.

9. A protective device as claimed in claim 1 in which said second means comprises a fluid operated piston and cylinder assembly arranged to effect engine dethrottling.

10. A protective device as claimed in claim 9 in which the piston and cylinder assembly is hydraulically operated.

11. A protective device as claimed in claim 10 in which said hydraulic piston and cylinder assembly is powered from at least one pressurized rechargeable hydraulic fluid supply tank.

12. A protective device as claimed in claim 9 in which the piston and cylinder assembly is connected to an activating fluid supply through a solenoid operated valve.

13. A protective device as claimed in claim 12 in which the solenoid operated valve is a double acting valve.

14. A protective device as claimed in claim 1 further comprising at least one counter responsive to said first means for counting occurrences of detected abnormal conditions.

15. A protective device as claimed in claim 14 further comprising a plurality of first means for detecting respective abnormal conditions and separate counters respectively responsive to said plurality of first means for counting detected abnormal conditions.

16. A protective device as claimed in claim 1 further comprising means for actuating an audible and visible warning device upon detection of an abnormal condition by said first means.

* * * * *